US006131244A

United States Patent [19]

Bares

[11] Patent Number: 6,131,244

[45] Date of Patent: Oct. 17, 2000

[54] ADJUSTABLE HANDLE COVER

[75] Inventor: James D. Bares, Gates Mills, Ohio

[73] Assignee: Meritool Corp., Chagrin Falls, Ohio

[21] Appl. No.: 09/354,676

[22] Filed: Jul. 16, 1999

[51] Int. Cl.[7] ..... B25G 1/06

[52] U.S. Cl. ..... 16/430; 16/422; 294/16; 30/341; 81/427.5

[58] Field of Search ..... 294/3, 8.5, 11, 294/16, 28, 57–59; 16/422, 430, 431; 30/134, 193, 312, 340, 341; 81/300, 385, 427.5, 489

[56] References Cited

U.S. PATENT DOCUMENTS

| | | | |
|---|---|---|---|
| 442,155 | 12/1890 | Virtus | 30/341 |
| 2,520,808 | 8/1950 | Miller | 30/341 |
| 2,578,230 | 12/1951 | Davis | 16/431 |
| 3,906,630 | 9/1975 | Megna | 30/341 |
| 4,829,858 | 5/1989 | Kern et al. | 81/427.5 |
| 5,253,557 | 10/1993 | Dolak | 30/340 |

FOREIGN PATENT DOCUMENTS

| | | | |
|---|---|---|---|
| 1116010 | 6/1968 | United Kingdom | 30/341 |

*Primary Examiner*—Dean J. Kramer
*Attorney, Agent, or Firm*—Vickers, Daniels & Young

[57] ABSTRACT

An adjustable handle cover for use on at least one of two handles of a hand tool relatively displaceable in a given direction to allow the two handles to accommodate a range of hand spans. The one handle has an outer surface facing away from the other handle, and the adjustable handle cover includes a first end, a second end, and outer peripheral surface between the two ends, and an elongated passageway extending eccentrically with respect to the peripheral surface into the cover from the first end toward the second end. The passageway is shaped to selectively receive the one handle in a first or a second orientation, and the peripheral surface is at a first distance from the outer surface when in the first orientation, and at a second distance from the outer surface when in the second orientation.

36 Claims, 4 Drawing Sheets

ADJUSTABLE HANDLE COVER

BACKGROUND OF THE INVENTION

This invention relates to the art of handle covers and, more particularly, to an adjustable handle cover to accommodate a range of hand spans.

The present invention finds particular utility in producing an ergonomic connection between a hand tool with a two handle configuration and the user's hand, and accordingly, is disclosed and described in detail hereinafter in connection with such use. However, it will be appreciated that the invention is applicable to use in connection with other handle configurations.

Ergonomics is the study of human capability and psychology in relation to the working environment and the equipment operated by the worker. As applied to hand tools, ergonomics relates to the use of the human hand to produce the forces required to operate the hand tool. Furthermore, ergonomics relates to designing hand tools that require less hand force to operate and reduce fatigue, injury or damage caused by long term repetitive use.

The industry has begun to design hand tools that better conform to the human hand. In consideration of the large range in sizes of the human hand, it has been difficult, if not impossible to produce a hand tool that is ergonomic to all users. One handle configuration is not capable of ergonomicaly conforming with a wide range of hand spans. Accordingly, attempts have been made to address multiple hand spans, but none have produced a cost effective product line that meets the needs of the end user.

One method of addressing multiple hand spans is to create a tool in a plurality of sizes. For instance, a small sized tool would be produced from handles designed for a small hand span while a large sized tool would be produced from handles designed for a larger hand. The result of this method is high inventory costs and the reduced ability to accommodate the end user. Even though one size may out perform other sizes, all sizes must be inventoried to accommodate the end user having either very small or very large hand spans.

In order to better service the end user and reduce inventory costs, attempts have been made to utilize a single handle design to accommodate a range of hand spans. One method has been to produce a handle that conforms with one particular hand span and then utilize mechanical means to reform the shape of the handle so that it will conform to other hand spans. This method requires an additional operation to produce handle spans of differing sizes which typically includes physically bending at least one handle. Operations such as these must be performed under controlled circumstances thereby preventing adjustment by the end user. While this method can reduce inventory costs by allowing one size to be inventoried, it lengthens the lead time between order and delivery by adding an operation. Furthermore, once a tool has been formed to a special handle span, it cannot be subsequently changed, thereby reducing flexible manufacturing techniques.

Another method is to produce handle blanks to conform with only the largest hand span and then smaller hand spans are accommodated by varying the amount of material that is removed from the working or cutting edge of the tool's jaw. More particularly, as more material is removed from the working surface of the jaw, the smaller the handle span becomes. While this method also allows one pair of handles to accommodate multiple handle spans, it requires additional and more complex metal removal steps to produce the desired handle span. This not only increases the cost associated with manufacturing the tool, but also increases the lead times and inventory costs associated with reacting to the needs of the end user.

Another method of addressing multiple hand spans is to use special pivot hardware. This method can include the common slip joint pivot. This joint includes one handle with a plurality of pivot slots or openings and the other handle with pivot hardware designed to selectively engage each of these slots or openings. A pivot such as this allows adjustment of the handle span based on which slot or opening is utilized. While this method allows for the end users to adjust the handle span based on their needs, it is costly to produce, the pivot area is very large, and the pivot joint can inadvertently become misadjusted during use. While this approach is satisfactory for pliers, it does not work with cutting tools where the jaws must close. These attributes create a tool that is expensive and difficult to use.

In an effort to address the shortcomings of the slip joint tool, tools have been designed to include a slip joint pivot that automatically adjusts the handle span. While this reduces the clumsiness of the tool and eliminates the need to choose the proper pivot slot each time the tool is used, the pivot area remains very large, expensive and complex in design. Furthermore, while both the standard and the automatic slip joint tools can be utilized to meet the needs of a range of hand spans, they are not well adapted for repetitive use by the end user.

SUMMARY OF THE INVENTION

In accordance with the present invention, improved handle covers are provided for adjusting handle spans of a hand tool without structural changes to the handles, pivot joint or jaws of the hand tool. Furthermore, the handle covers allow for adjustment of the handle span by the end user. Not only does this allow for the end users to decide which size is the best for their particular hand span, it allows the supplier to reduce both manufacturing costs and inventory costs.

A handle cover according to the present invention allows a single handle blank to be utilized to accommodate multiple hand spans. Furthermore, the adjustment is accomplished without the need for secondary metal removal operations or handle forming operations. As a result, the manufacturer is only required to produce tooling for a single handle to create an ergonomic hand tool for a range of hand spans. Not only are costs reduced, but the ability to service the end user is improved by reducing secondary operations.

The foregoing advantages are achieved in accordance with the present invention by a handle cover that produces the desired change in the handle span. More particularly, a handle cover that allows the overall handle span to be adjusted based on the relationship between the cover's inwardly facing surfaces and its outer peripheral surface. Not only does the handle cover create an ergonomic shaped interengagement between the hand tool and the hand, it can also be re-orienated to subsequently change the tool's handle span based on the needs of the end user.

It is accordingly an outstanding object of the present invention to provide improved handle covers for adjusting the handle span of a hand tool without modification to the pivot, jaws or handles.

A further object of the present invention is to provide tool handle covers that are ergonomic.

It is yet another outstanding object of the present invention to provide tool handle covers that reduce manufacturing costs and inventory costs for the tools.

It is yet a further outstanding objective to provide tool handle covers that reduce the lead time between customer order and customer delivery of the tools.

It is still a further objective of the present invention to provide tool handle covers that create an ergonomic hand tool even though a common handle design is used for both handles.

BRIEF DESCRIPTION OF THE DRAWINGS

The foregoing objects, and others, will in part the obvious and in part pointed out more fully hereinafter in conjunction with the written description of preferred embodiments of the invention illustrated in the accompanied drawings in which.

DESCRIPTION OF PREFERRED EMBODIMENTS

Figure 1:
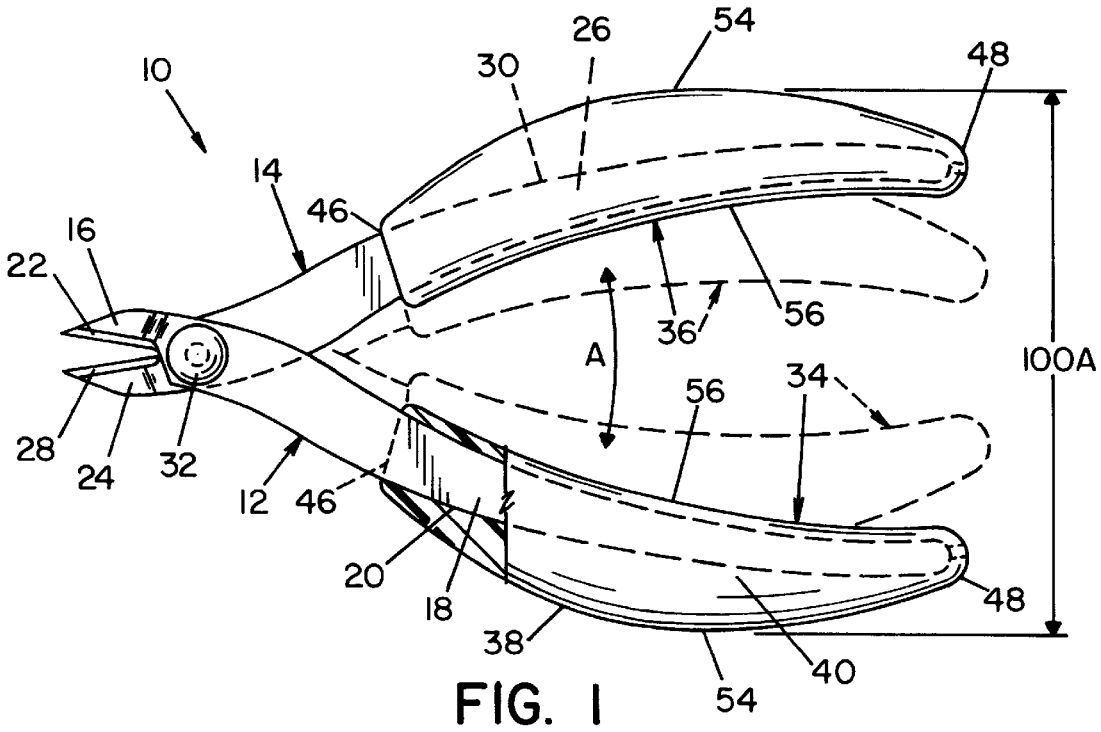
FIG. 1 is a top view of a hand tool including a pair of handle covers in accordance with the present invention wherein the large handle span is shown.

Referring now in greater detail to the drawings wherein the showings are for the purpose of illustrating preferred embodiments of the invention only, and not for the purpose of limiting the invention, FIG. 1 illustrates a hand tool 10 which comprises an upper handle 12 and a lower handle 14, which can be made from an identical handle blank, and handle covers 34 and 36.

Upper handle 12 includes both a jaw portion 16 and a handle portion 18, and handle portion 18 includes an outer edge 20 that can move in opposite directions as shown by arrow A. Jaw portion 16 has a working and/or cutting edge 22. Lower handle 14 includes a jaw portion 24 and a handle portion 26, and lower jaw portion 24 has a working and/or cutting edge 28. Lower handle 14 further includes outer edge 30 that can move in the direction of arrow A relative to outer edge 20. Upper handle 12 and lower handle 14 are joined by pivot rivet 32. The broken lines show hand tool 10 closed by movement of the handles toward one another. When closed, working and/or cutting edge 22 engages working and/or cutting edge 28.

Handle cover 34 is shown on upper handle portion 18 and in the preferred embodiment is of the same structure as handle cover 36 that is shown on lower handle portion 26. Handle covers 34 and 36 can be made of any suitable material and preferably are made of a low durometer elastomeric material with a shore hardness in the range of A-30–70, and the outer surfaces can include a finish such as a surface roughness creating a friction increasing surface to help the user maintain control of the hand tool. In the illustrated embodiment, handle portions 18 and 26 are arcuate between the opposite ends thereof such that outer edges 20 and 30 are convex relative to one another.

Figure 2:
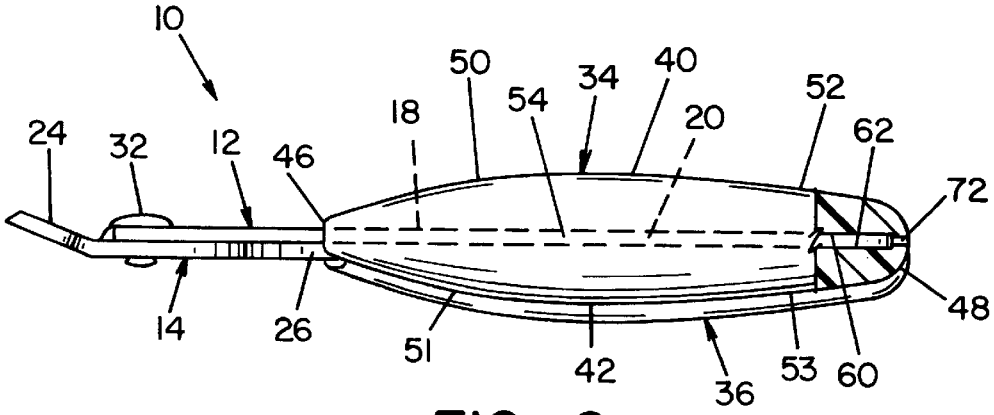
FIG. 2 is a side elevation view of the hand tool and handle covers illustrated in FIG. 1.
Figure 5:
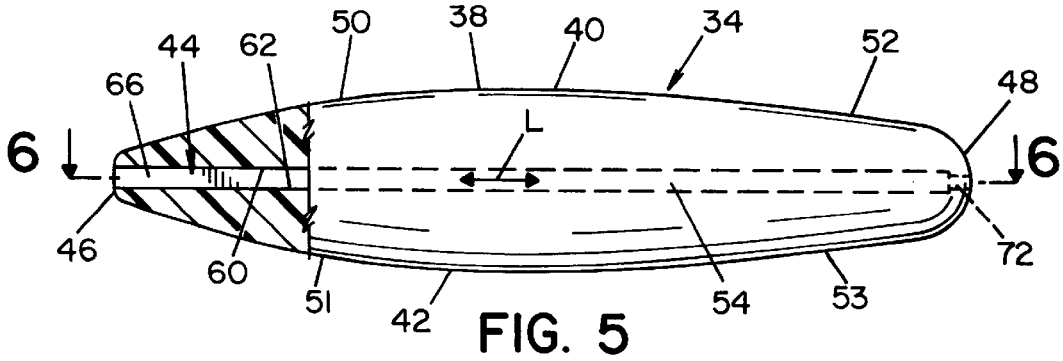
FIG. 5 is a side view, partially in section, of a handle cover in accordance with the present invention.
Figure 6:
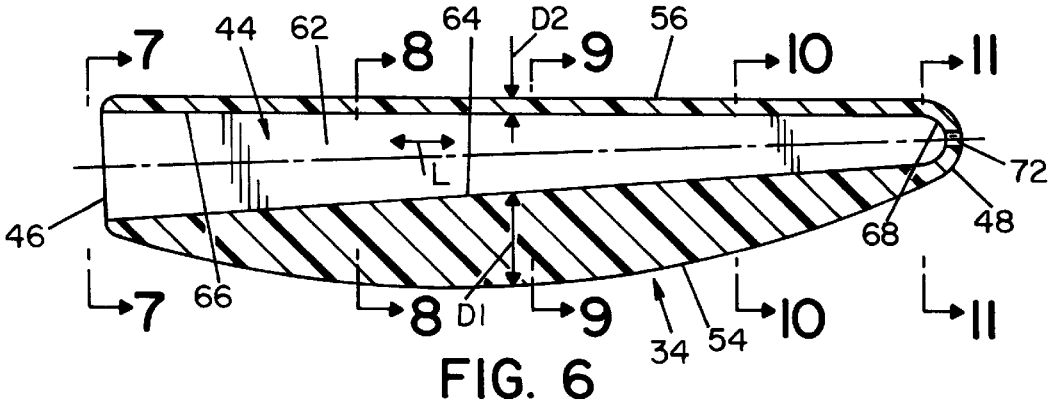
FIG. 6 is a sectional view taken along line 6—6 in FIG. 5.
Figure 7:
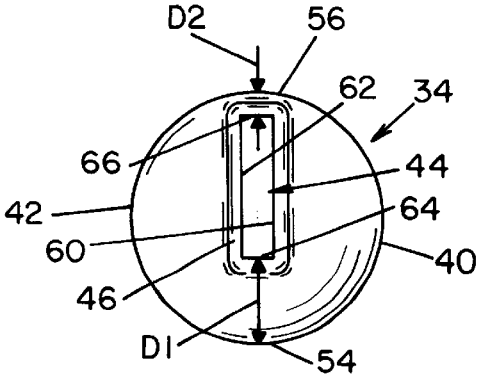
FIG. 7 is an end elevation view of the handle cover as seen along line 7—7 in FIG. 6.
Figure 8:
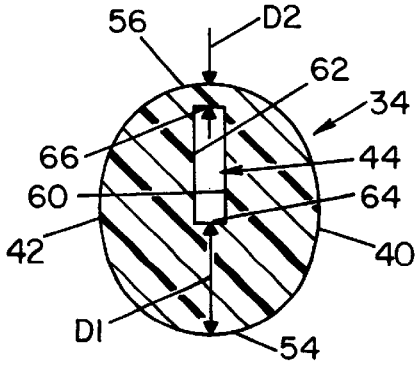
FIG. 8 is a sectional elevation view taken along line 8—8 in FIG. 6.
Figure 9:
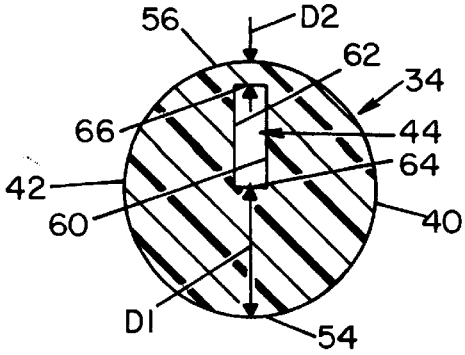
FIG. 9 is a sectional elevation view taken along line 9—9 in FIG. 6.
Figure 10:
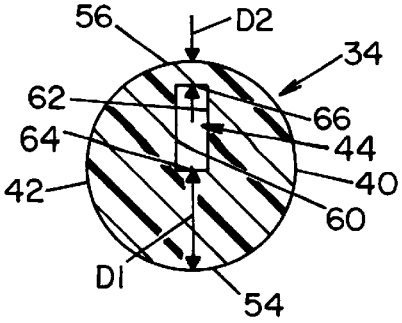
FIG. 10 is a sectional elevation view taken along line 10—10 in FIG. 6.
Figure 11:
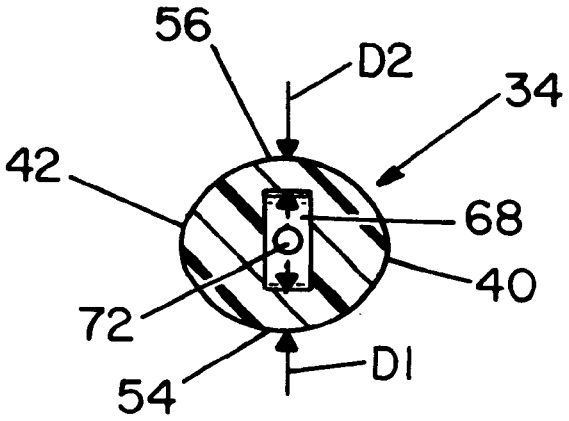
FIG. 11 is a sectional elevation view taken along line 11—11 in FIG. 6.

In the preferred embodiment, handle covers 34 and 36 are identical, whereby it will be appreciated that the following description of handle cover 34 with reference to FIGS. 5 and 6 is also applicable to handle cover 36. FIG. 5 shows cover 34 oriented according to FIG. 2. Cover 34 includes an elongated passageway 44 that extends in a longitudinal direction L into cover 34 from first end 46 of the cover to just short of second end 48 of the cover. Passageway 44 is defined by inwardly facing surfaces, namely, inwardly facing top surface 60, inwardly facing bottom surface 62 which is parallel to surface 60, first inwardly facing side surface 64, and second inwardly facing side surface 66. Top surface 60 is contiguous with both first and second side surfaces 64 and 66, and bottom surface 62 is also contiguous with both first and second side surfaces 64 and 66. The surfaces 60, 62, 64 and 66 are substantially planar and define a passageway 44 having a rectangular cross sectional shape.

First side surface 64 and second side surface 66 extend toward second end 48 of cover 34 and come together at end surface 68 having a radius of curvature of approximately 0.1 inch. Generally centered in end surface 68 is end hole 72 which aids in the assembly process by reducing the installation forces by releasing the air pressure produced when cover 34 is installed on handle portion 18. In the preferred embodiment, elongated passageway 44 includes a taper in longitudinal direction L along its length. More particularly, first and second side surfaces 64 and 66 converge along passageway 44 as they approach end surface 68. This taper also aids in the assembly process by further reducing installation forces when cover 34 is installed on handle portion 18. These forces are reduced by delaying the interference or frictional engagement between side surfaces 64 and 66 and handle portion 18 until handle portion 18 has been inserted partially into passageway 44. The interference or frictional force utilized to prevent inadvertent disengagement is not reached until handle portion 18 has substantially penetrated passageway 44.

The inwardly facing surfaces 60, 62, 64 and 66, of cover 34 are designed to engage handle portion 18 to produce the frictional forces to prevent cover 34 from inadvertently disengaging handle portion 18. In this respect, while passageway 44 is generally straight, the elastomeric material allows cover 34 to conform to the curve of handle portion 18, whereby the resiliency of the material enhances engagement between the handle and cover. Further, it is preferred that an interference fit between elongated passageway 44 and handle portion 18 be used for engagement wherein elongated passageway 44 either between surfaces 60 and 62 and/or between surfaces 64 and 66 is slightly smaller than handle portion 18, whereby the material of the cover stretches when the cover is mounted on the handle portion. In addition, other forms of interengagement can be utilized to prevent inadvertent removal of cover 34 from handle portion 18 such as interengaging contours between handle portion 18 and cover 34 that can include, for example, a rib in handle portion 18 and a corresponding detent in passageway 44.

Elongated passageway 44 of cover 34 extends eccentrically with respect to outer peripheral surface 38 which enables the handle span to be changed. More particularly, peripheral surface 38 of cover 34 includes top surface 40 and bottom surface 42 that are generally convex with respect to elongated passageway 44. Top surface 40 is essentially a mirror image of bottom surface 42 and both extend between first end 46 and second end 48 of cover 34. Top surface 40 includes multiple arcuate surface portions including first surface portion 50 having a radius of curvature in the range of 2 to 7 inches and preferably approximately 4.5 inches and second surface portion 52 having a radius of curvature in the range of 12 to 18 inches and preferably approximately 15 inches. As with top surface 40, bottom surface 42 includes multiple arcuate surface portions including first surface portion 51 having a radius of curvature in the range of 2 to 7 inches and preferably approximately 4.5 inches and second surface portion 53 having a radius of curvature in the range of 12 to 18 inches and preferably approximately 15 inches. Peripheral surface 38 of cover 34 further includes arcuate side surface portion 54 and straight side surface portion 56 that extend between first end 46 and second end 48 of cover 34. Arcuate surface portion 54 is also convex in relation to elongated passageway 44 having a radius of curvature in the range of 4 to 5 inches and preferably approximately 4.4 inches. Straight surface portion 56 is generally straight in longitudinal direction L. Top surface 40 and bottom surface 42 are both contiguous with side surface portions 54 and 56. Top surface 40 further includes third surface portion transverse to passageway 44 having a radius of curvature that is less than 1.5 inches and preferably less than 0.5 inches. Bottom surface 42 also includes a third surface portion transverse to passageway 44 having substantially the same radius of curvature.

Referring to FIGS. 6–11, the eccentricity of elongated passageway 44 in relation to peripheral surface 38 defines a different distance between first inwardly facing side surface 64 and surface portion 54, and between second inwardly facing side surface 66 and surface portion 56. More particularly, distance D1 which is defined by the distance between surface portion 54 and first inwardly facing side surface 64 is greater than distance D2 which is defined by the distance between surface portion 56 and second inwardly facing side surface 66. In the preferred embodiment, the eccentricity of elongated passageway 44 varies along longitudinal direction L as a result of arcuate surface portion 54. Accordingly, distance D1 varies along longitudinal direction L, but distance D1 remains greater than distance D2 along the entirety of surfaces 64 and 66 of passageway 44.

Figure 3:
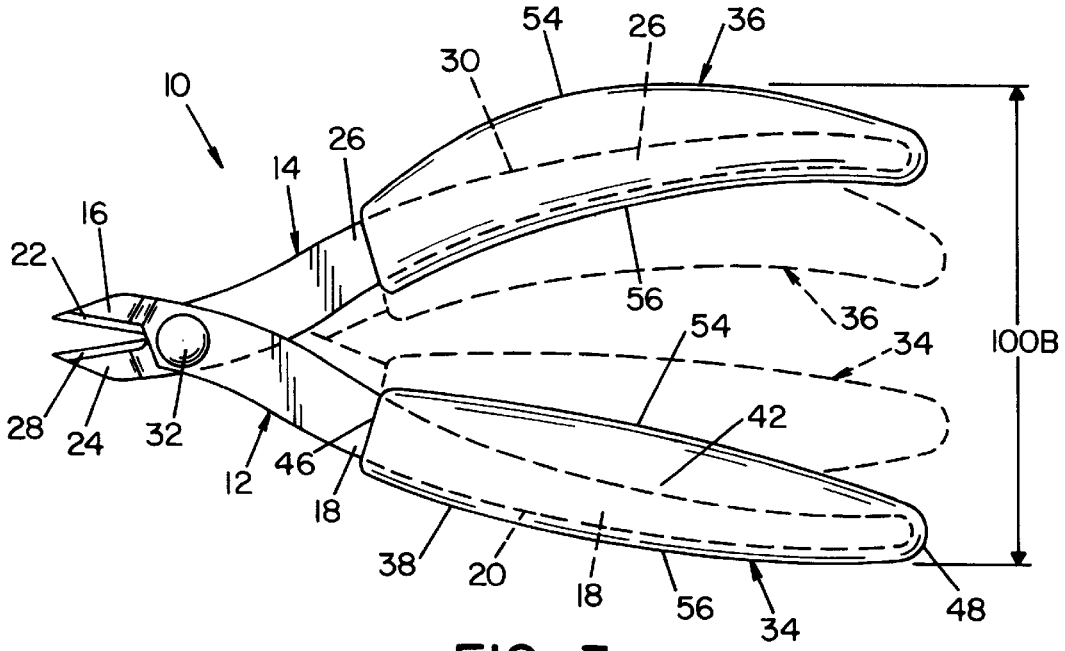
FIG. 3 is a top view of the hand tool and the handle covers as shown in FIG. 1 wherein the handle covers are oriented for the medium handle span.
Figure 4:
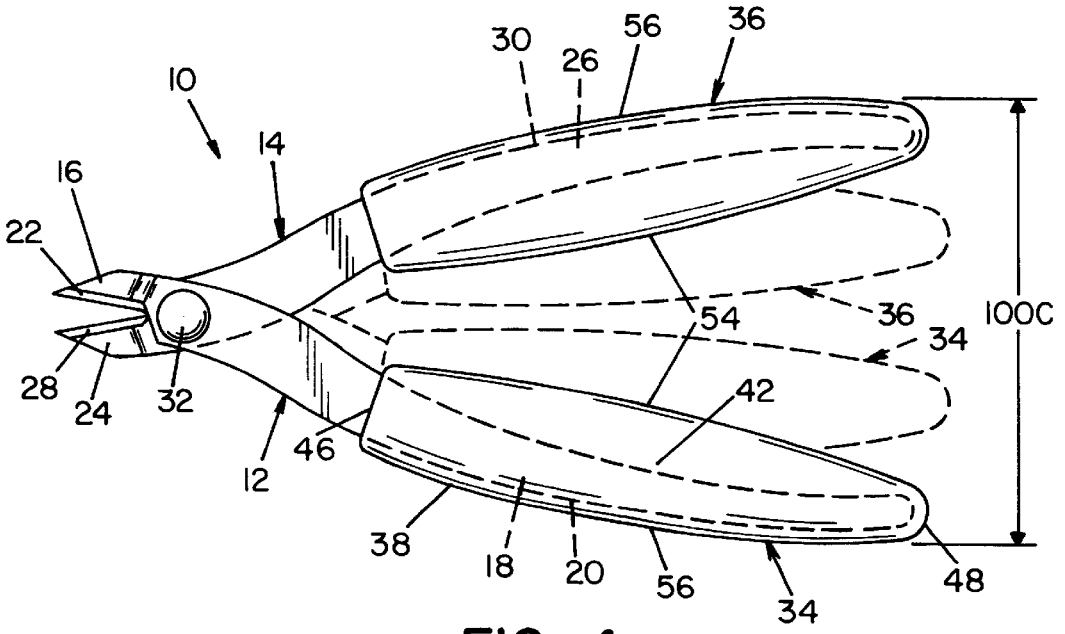
FIG. 4 is a top view of the hand tool and the handle covers as shown in FIG. 1, wherein the handle covers are oriented for the small handle span.

The eccentric relationship between outer peripheral surface 38 and elongated passageway 44 allows selective positioning of handle covers 34 and 36 to easily adjust the handle span of hand tool 10 by selective orientation of the covers on handle portions 18 and 26 respectively. Referring to FIGS. 1, 3 and 4, large, medium and small handle spans 100A, 100B and 100C, respectively, are shown. FIG. 1 illustrates handle span 100A, wherein arcuate surface portion 54 of cover 34 faces outwardly from outer edge 20 of upper handle portion 18 while arcuate surface portion 54 of cover 36 faces outwardly from outer edge 30 of lower handle portion 26. Therefore, surface portions 54 of handle covers 34 and 36 are convex relative to one another and, since surface portion 54 corresponds to distance D1 which is greater than distance D2, and both surfaces 54 of covers 34 and 36 are facing outwardly relative to the corresponding handle portion, 100A represents the largest handle span and is well suited for persons with large hand spans.

FIG. 3 illustrates handle span 100B which is achieved by removing cover 34 from handle portion 18 and reorienting and remounting the cover on handle portion 18 so that surface portion 56 of cover 34 is facing outwardly of edge 20 thereof. Since surface 56 corresponds to distance D2 which is less than D1, the handle span has thus been reduced. More particularly, the large handle span 100A has been reduced by D1–D2 to provide handle span 100B and this produces a medium handle span and is well suited for persons with medium hand spans. FIG. 4 illustrates handle span 100C which is produced by reorienting both covers 34 and 36 with respect to FIG. 1. More particularly, covers 34 and 36 are removed from handle portions 18 and 26 respectively and reorientated so that surface portions 56 of both covers 34 and 36 are facing outward of the corresponding one of outer edges 20 and 30. Since surface 56 corresponds to distance D2 which is less than D1, the handle span has been reduced even further than handle span 100B. More particularly, the largest handle span 100A has been reduced by 2×(D1–D2) to provide handle span 100C. This produces a small handle span and is well suited for persons with small hand spans.

Even though handle covers according to the present invention can produce handle spans 100A, 100B and 100C, the configuration of upper handle 12, lower handle 14 and pivot 32 remain the same. This allows for the use of one hand tool assembly 10, with a common set of handles 12 and 14, to be ergonomically utilized by a wide range of hand spans.

In addition to adjusting the handle span, covers 34 and 36 can further increase the ergonomic connection between tool 10 and the user's hand by reconfiguring the contour of the hand engaging surface of tool 10 without modifying handles 12 or 14. Therefore, regardless of the configuration of outer edges 20 and 30 of handles 12 and 14 respectively, covers 34 and 36 can create the optimal engaging curve for hand tool 10 to conform with the user's hand. The ergonomic connection is produced by modifying the outer peripheral surface 38 in relation to elongated passageway 44 to vary distance D1 or D2 in longitudinal direction L. The change in outer peripheral surface 38 would be based on the configuration of outer edges 20 and 30 of the handles 18 and 26 respectively. In the preferred embodiment of this invention, only distance D1 is varied in longitudinal direction L, but both distances D1 and D2 could be varied in longitudinal direction L based on the configuration of outer edges 20 and 30 of handles 18 and 26 respectively.

While the preferred embodiment of the present invention describes cover 36 to have the same structure as cover 34, cover 36 could include a different structure than cover 34 based on the configuration of handle portions 18 and 26 and/or the application of the hand tool. In addition, one cover 34 according to the present invention could be utilized on one handle while a conventional cover or other griping surface remains apart of the other handle or other griping portion of the tool.

Figure 12:
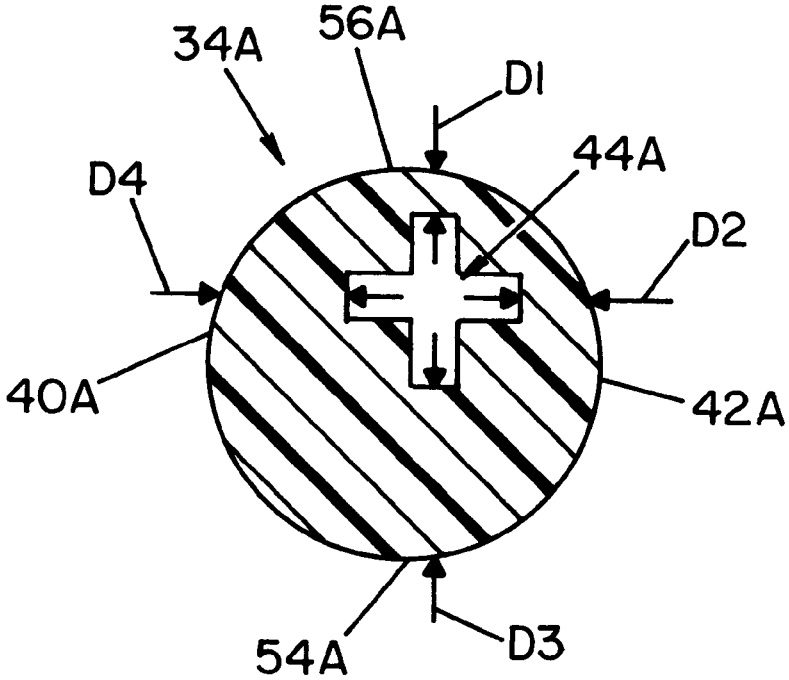
FIG. 12 is a sectional elevation view of an alternative embodiment of the present invention.

Referring to FIG. 12, wherein elongated passageway 44A is shown, elongated passageway 44 can be modified to allow for greater than two orientations of covers 34 and/or 36. Elongated passageway 44A is shown in a cover 34A that has four potential orientations relative to a tool handle. This embodiment can be utilized to accommodate a larger range of hand spans or to allow for more incremental adjustment of the handle span. The four different distances: D1, D2, D3, and D4 result from the eccentricity of elongated passageway 44A in relation to peripheral surface 38A. More particularly, distance D1 is the distance between passageway 44A and surface portion 56A; distance D2 is the distance between passageway 44A and surface portion 42A; distance D3 is the distance between passageway 44A and surface portion 54A; and D4 is the distance between passageway 44A and surface portion 40A wherein distances D1, D2, D3, and D4 are unequal to one another. It will be appreciated that cover 34A is adapted to be received on a tool handle such as handle 18 in FIG. 1 with the cover selectively oriented in one or the other of the opposite direction that would provide for surfaces 54A and 56A to be outwardly of edge 20 of the handle, or in one or the other of the opposite directions that would provide for surfaces 40A and 42A to be outwardly of edge 20.

While considerable emphasis has been placed on the preferred embodiment of the invention illustrated and described herein, it will be appreciated that other embodiments can be made and that many changes can be made in the preferred embodiments without departing from the principals of the invention. Accordingly, it is to be distinctly understood the foregoing descriptive matter is to be interpreted merely as illustrative of the invention and not as a limitation.

Having thus described the invention, it is claimed:

1. An adjustable handle cover for use on at least one of two handles of a tool to allow the two handles to ergonomically accommodate a range of hand spans, said one handle having an outer surface facing away from said other handle and being displaceable relative to said other handle in a given direction, said adjustable handle cover comprising: a first end, a second end, an outer peripheral surface between said first end and said second end, and an elongated passageway extending eccentrically with respect to said peripheral surface into said cover from said first end toward said second end, said passageway including a first inwardly facing surface and a second inwardly facing surface and being shaped to selectively receive said one handle in a first and a second orientation, said first inwardly facing surface being juxtaposed said outer surface and a first distance from said peripheral surface when said handle cover is in said first orientation and said second inwardly facing surface being juxtaposed said outer surface and a second distance from said peripheral surface when said handle cover is in said second orientation, said second distance being different from said first distance.

2. The adjustable handle cover of claim 1, wherein said cover is composed of an elastomeric material with a low durometer hardness.

3. The adjustable handle cover of claim 2, wherein said low durometer is a shore hardness of A-30–70.

4. The adjustable handle cover of claim 1, wherein said passageway extends in a longitudinal direction and said first orientation and said second orientation are angularly spaced from each other with respect to said longitudinal direction.

5. The adjustable handle cover of claim 4, wherein the angular spacing is generally 180°.

6. The adjustable handle cover of claim 1, wherein said passageway is generally rectangular in cross-section, said first inwardly facing surface being opposed to said second inwardly facing surface and joined therebetween by parallel third and fourth inwardly facing surfaces.

7. The adjustable handle cover of claim 6, wherein said first and second inwardly facing surfaces converge from said first end toward said second end.

8. The adjustable handle cover of claim 1, wherein said peripheral surface of said handle cover includes a friction increasing surface texture.

9. The adjustable handle cover of claim 1, wherein said passageway extends in a longitudinal direction and said peripheral surface includes a first portion and a second portion diametrically opposed to said first portion relative to said longitudinal direction, said first portion facing outwardly from said outer surface said first distance when in said first orientation and said second portion facing outwardly from said outer surface said second distance when in said second orientation.

10. The adjustable handle cover of claim 9, wherein at least one portion of said first and second portions of said peripheral surface includes an arcuate portion extending in said longitudinal direction.

11. The adjustable handle cover of claim 10, wherein said arcuate portion includes a first radius in the range of 2 to 7 inches.

12. The adjustable handle cover of claim 10, wherein said arcuate portion includes a radius in the range of 4 to 5 inches.

13. The adjustable handle cover of claim 10, wherein the other portion of said at least one portion of said first and second portions extends generally straight in said longitudinal direction.

14. The adjustable handle cover of claim 9, wherein said outer peripheral surface includes at least one planar surface portion.

15. The adjustable handle cover of claim 9, wherein said first orientation and said second orientation are angularly spaced from each other relative to said longitudinal direction of said passageway.

16. The adjustable handle cover of claim 15, wherein the angular spacing is generally 180°.

17. The adjustable handle cover of claim 9, wherein said peripheral surface includes a friction increasing surface texture.

18. An adjustable handle cover for use on at least one of two handles of a tool to allow the two handles to ergonomically accommodate a range of hand spans, said one handle having an outer surface facing away from said other handle and being displaceable relative to said other handle in a given direction, said adjustable handle cover comprising: a first end, a second end, an outer peripheral surface between said first end and said second end, and an elongated passageway extending eccentrically with respect to said peripheral surface into said cover from said first end toward said second end, said passageway including a first inwardly facing surface and a second inwardly facing surface and being shaped to selectively receive said one handle in a first and a second orientation, said first inwardly facing surface being juxtaposed said outer surface and a first distance from said peripheral surface when said handle cover is in said first orientation and said second inwardly facing surface being juxtaposed said outer surface and a second distance from said peripheral surface when said handle cover is in said second orientation, said second distance being different from said first distance, said passageway extending in a longitudinal direction and said peripheral surface including a first portion and a second portion diametrically opposed to said first portion relative to said longitudinal direction, said first portion facing outwardly from said outer surface said first distance when in said first orientation and said second portion facing outwardly from said outer surface said second distance when in said second orientation, wherein said peripheral surface further includes third and fourth portions extending between said first and second portions and said passageway further includes a third inwardly facing surface and an opposing fourth inwardly facing surface whereby said third inwardly facing surface is a third distance from said peripheral surface and said fourth surface is a fourth distance from said peripheral surface.

19. The adjustable handle cover of claim 18, wherein said third distance and said fourth distance are substantially equal.

20. The adjustable handle cover of claim 18, wherein said third distance and said fourth distance are different.

21. The adjustable handle cover of claim 18, wherein at least one of said third and fourth portions of said peripheral surface includes a second arcuate portion transverse to said passageway and said at least one of said third and fourth portions being contiguous to said first and second portions.

22. The adjustable handle cover of claim 21, wherein said second arcuate portion includes a radius less than 1.5 inches.

23. The adjustable handle cover of claim 22, wherein said radius is less than 0.5 inches.

24. The adjustable handle cover of claim 18, wherein at least one of said third and fourth portions include a third arcuate portion extending in said longitudinal direction.

25. The adjustable handle cover of claim 24, wherein said third arcuate portion has a radius in the range of 12 to 18 inches.

26. The adjustable handle cover of claim 24, wherein said at least one of said third and fourth portions further includes a fourth arcuate portion extending in said longitudinal direction, said fourth arcuate portion having a radius in the range of 3 to 6 inches.

27. The adjustable handle cover of claim 26, wherein said radius of said third arcuate portion is in the range of 12 to 18 inches.

28. An adjustable handle cover for use on at least one of two handles of a hand tool, said handles being pivotally joined to move toward and away from each other in a given direction, said handles each including an elongated portion having a cross-sectional profile, said cover comprising: an elongated body having a first and a second end with a handle receiving passageway extending in a longitudinal direction between said ends said passageway having an entrant opening at said first end and inwardly facing handle engaging surfaces allowing said handle to be received in said passageway in at least a first and a second angular orientation relative to said longitudinal direction, said handle cover further including a first peripheral portion spaced outwardly of said handle in said given direction a first distance when said handle cover is in said first orientation and a second peripheral portion spaced outwardly of said handle in said given direction a second distance when said cover is in said second orientation, said first and second distances being different to provide different gripping spans for said hand tool.

29. The adjustable handle cover of claim 28, wherein said profile of said handle is a rectangle and said first and second angular orientations are at an angle of 180° from each other.

30. The adjustable handle cover of claim 29, wherein said passageway handle engaging surfaces define a cross-sectional shape generally matching said profile of said elongated portion.

31. The adjustable handle cover of claim 28, wherein said passageway handle engaging surfaces define a cross-sectional shape generally matching the profile of said elongated portion.

32. A method of using a first and a second handle cover on two relatively displaceable handles of a tool to produce at least three handle spans including the step of selectively orienting said first cover on a first handle of said two handles and selectively orienting a second cover on a second handle of said two handles, each said first and second covers comprising a first end, a second end, an outer peripheral surface between said first end and said second end, and an elongated passageway extending eccentrically with respect to said peripheral surface into said covers from said first end toward said second end, said passageway being shaped for said first and second covers to respectively receive said first and second handles in at least a first orientation and a second orientation, wherein a first handle span is produced when said first cover is in said first orientation and said second cover is in said first orientation, a second handle span is produced when said first cover is in said second orientation and said second cover is in said first orientation, and a third handle span is produced when said first cover is in said second orientation and said second cover is in said second orientation.

33. The method of using the first and second handle cover of claim 32, wherein said passageway extends in a longitudinal direction and said first orientation and said second orientation of said first and second handle covers are angularly spaced from each other with respect to said longitudinal direction.

34. The method of using the first and second handle cover of claim 33, wherein the angular spacing is 180°.

35. The method of using the first and second handle cover of claim 34, wherein said passageway converges from said first end toward said second end.

36. The method of using the first and second handle cover of claim 32, wherein said passageway converges from said first end toward said second end.

* * * * *